United States Patent [19]

Wallers

[11] 4,055,224

[45] Oct. 25, 1977

[54] METHOD FOR FORMING AN UNDERGROUND CAVITY

[76] Inventor: Richard A. Wallers, 111 Amethyst Ave., Balboa Island, Calif. 92662

[21] Appl. No.: 592,169

[22] Filed: July 1, 1975

[51] Int. Cl.[2] ..... E21B 7/12

[52] U.S. Cl. ..... 175/5; 175/171; 175/213

[58] Field of Search ..... 175/171, 173, 205, 213, 175/263, , 5, 7–9; 166/5; 61/46, 46.5, 81

[56] References Cited

U.S. PATENT DOCUMENTS

| | | | |
|---|---|---|---|
| 987,266 | 3/1911 | Smith | 175/9 |
| 1,665,795 | 4/1928 | Sipe | 61/81 X |
| 2,076,379 | 4/1937 | Marsden | 175/171 |
| 3,063,500 | 11/1962 | Logan | 166/.5 |
| 3,262,508 | 7/1966 | Price | 175/171 X |
| 3,380,256 | 4/1968 | Rebikoff | 61/81 X |
| 3,648,788 | 3/1972 | McKinney | 175/205 |
| 3,677,113 | 7/1972 | Bowles | 61/52 X |
| 3,757,876 | 9/1973 | Pereau | 175/267 |

*Primary Examiner*—Ernest R. Purser
*Assistant Examiner*—Richard E. Favreau
*Attorney, Agent, or Firm*—Lyon & Lyon

[57] ABSTRACT

A caisson and connecting conductor pipe sections are lowered to a predetermined position on the ocean underwater floor. A drill stem having a combined drilling and reaming tool is positioned within the conductor pipe and caisson. Drilling mud is reversed-circulated through the annular space between the conductor pipe and caisson and the drill stem, the drilling mud returning through the drill stem. The tool mounted on the drill stem is utilized to drill to a predetermined depth whereupon one or more reaming arms open outward from the tool and are rotated, thereby cutting out a volume of the ocean floor within which the caisson may be positioned.

12 Claims, 3 Drawing Figures

METHOD FOR FORMING AN UNDERGROUND CAVITY

BACKGROUND OF THE INVENTION

Figure 1A:
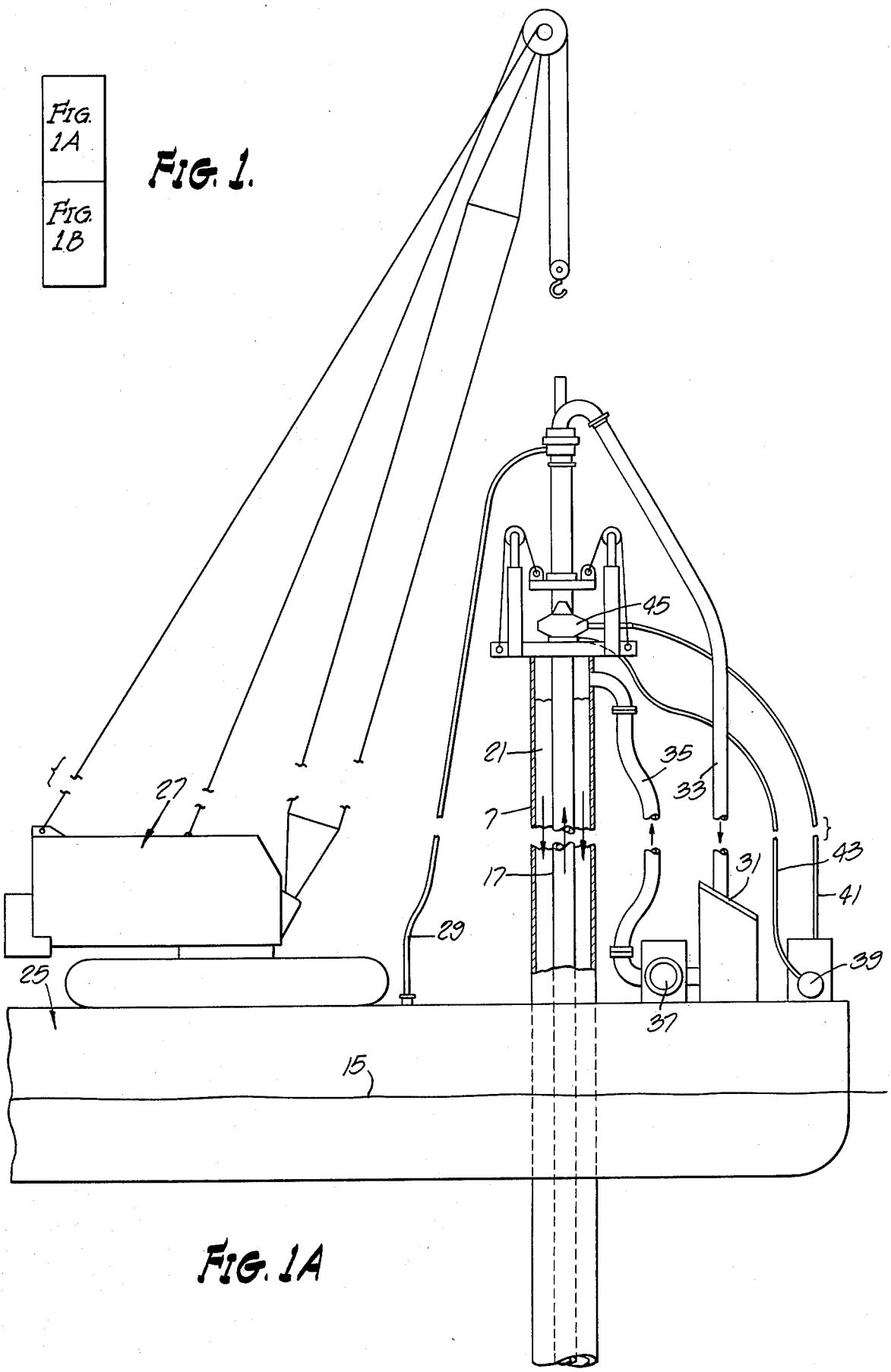

The invention relates to a method of caisson placement in offshore locations. The caisson may be utilized to provide protection for items of equipment at the top of a wellbore, such as blowout protection devices or stacks which prevent the uncontrolled flow of gas, oil or other well fluids to the surrounding environment.

BRIEF DESCRIPTION OF THE PRIOR ART

In the drilling industry, and particularly with respect to the portion of the industry dealing with petroleum exploration and production, blowout prevention or protection devices are typically installed at the wellhead in order to control the flow of gas, oil or other well fluids. When drilling on land, such blowout prevention devices are often located within an excavation under the derrick termed a "celler" which is excavated before the drilling of the well in order to provide a working space for items of equipment at the top of the wellbore. Such a cellar also provides a certain amount of protection for the blowout prevention devices.

When drilling offshore, the need for such protection of the blowout prevention devices is even greater. When a well is located in shallow waters, an exposed blowout prevention device might be damaged or rendered inoperable upon being struck by the hull of a ship, or a ship's anchor. Additionally, in fishing waters, a blowout prevention device may be rendered inoperable by becoming tangled with fishing nets. Furthermore, in those areas of offshore exploration such as off the coast of Alaska, the climatic extremes produce large ice packs and icebergs which gouge a portion of the ocean floor during their movements. It is of the utmost concern to those placing such blowout prevention devices on wellheads that the devices not be rendered inoperable due to any of the foregoing reasons.

Thus, attempts have been made to excavate a portion of the ocean or sea floor in order to provide protection for the blowout device. Due to the rather large area which must be provided about the top of the wellhead in order to allow for the blowout protection device to be adequately installed, maintained and operated, the conventional drilling techniques do not produce a hole of adequate diameter within which protection for the blowout protection device may be placed.

One method of providing the necessary excavation required for the placement of a caisson is to utilize a water jet which due to the high velocity of the jet, removes a volume of the ocean or sea floor. However, such an approach has two distinct disadvantages. First, there is a substantial problem of cave-in adjacent the wall of the excavation. Additionally, it has proven to be extremely difficult to maintain vertical alignment with such a water jet, particularly in those locations where the weather extremes and rough water make such operations very difficult.

Another technique is to drill a plurality of small holes around the peripheral area of the desired caisson location. After the hollow caisson is placed, the interior portion may then be mechanically excavated. Such an approach is unfeasible due to the high cost of drilling such a large number of holes, followed by the excavation of the interior portion within the caisson itself.

A third technique which might be employed is the technique utilized for excavation of tunnels wherein an air bell is lowered to the underwater floor thereby allowing for mechanical digging of a cavity wherein a caisson or other equipment may be placed. Such a technique is extremely expensive and there are substantial safety problems involved with utilization of such an air bell within which the mechanical excavation is performed.

A fourth technique consists of mounting a type of hammer/anvil arrangement on top of a pile and using air or steam to lift the hammer and allowing it to fall on its own weight on to the anvil thereby applying a blow to a pile driven into the sea floor. A variation of this pile hammer technique is the use of a "vibro-hammer" which utilizes two opposed rotating cams to provide vibrations to the pile that it is driven. Such a technique requires a structurally sound caisson which is capable of withstanding the hammer blows required to drive it into cohesive and possibly frozen ground beneath the sea. Further, such a process is necessarily time consuming and expensive.

All four of the above referenced techniques suffer from the disadvantage of requiring a substantial amount of time in order to produce an excavation of the desired volume. Time is of course an important criteria with respect to expense as the equipment utilized in such operations is very costly to operate and maintain. Additionally, in several offshore areas, such as the offshore region of Alaska, the working time is substantially reduced due to the climatic extremes and rough waters.

An object of this invention is to provide an improved method for placing an offshore caisson. Other objectives will become apparent upon a reading of the entire specification, drawings and claims.

SUMMARY OF THE INVENTION

The present invention deals with a method for placing an offshore caisson. Conductor piping sections are connected to the caisson and the pipe sections and caisson are lowered to a predetermined position on the sea floor. A drill stem having a combined drilling and reaming tool is then passed through the conductor pipe and the caisson until it rests on the sea floor. Drilling mud is circulated in a closed system through the annular space between the joined conductor pipe and the drill stem. The drilling mud is returned through the drill stem. The drilling tool is utilized to drill to a predetermined depth, whereupon one or more reaming arms of the tool open outwardly and ream upwardly forming a cylinderical cavity within which the caisson may be positioned. Alternately, the reaming operating may be carried out while the tool is maintained at a constant depth thereby forming a "bell shaped" cut. One or more bell shaped cuts may be required in order to produce a cavity of sufficient volume to accommodate the caisson. Thus following such a cutting operation the reaming arm or arms would be retracted and the reaming tool pulled upward to a predetermined depth prior to repeating the bell shaped cutting procedure. Finally, in certain soil conditions, the cutting and drilling tool may drill and ream downwardly so as to form a cavity for the caisson.

The drill stem and drilling and reaming tool may then be removed and the caisson and the conductor piping may be disconnected from the caisson. The drilling mud may be removed from the caisson and replaced with water. In a preferred embodiment, the upper portion of the caisson may be joined to the conductor piping by means of a cone shaped member.

BRIEF DESCRIPTIONS OF THE DRAWINGS

Figure 1B:
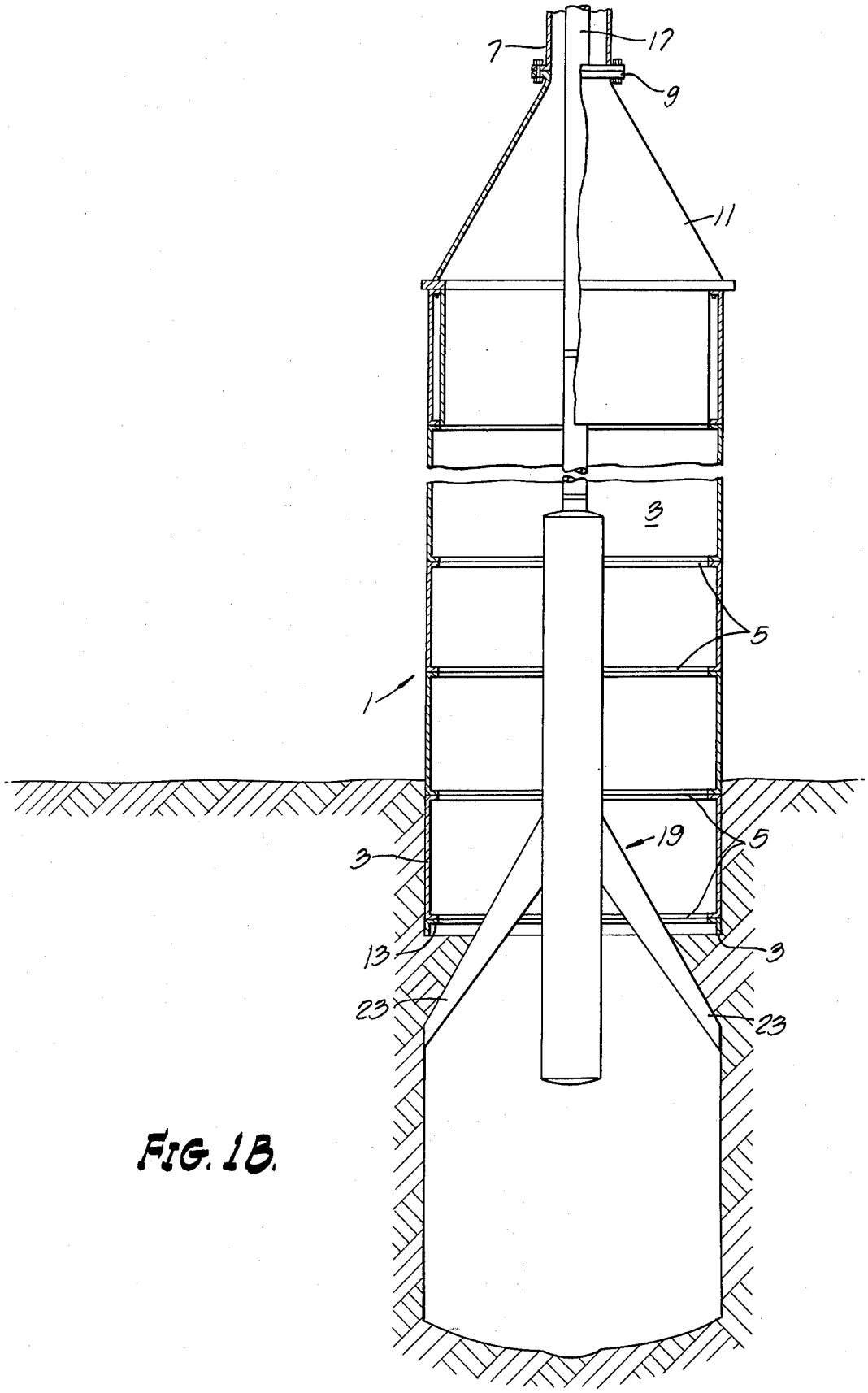

FIGS. 1*a* and 1*b* are schematic drawings in partial cross-section illustrating the present invention.

Referring now to FIG. 1B a caisson 1 is shown. The caisson may be cylindral in shape and formed from concrete or steel shaft liner plates or a plurality of sheets 3 whigh have been positioned in a circular configuration, being suitably joined by means such as bolts or welding at planes of juncture 5. While the dimensions of the caisson will obviously vary from one application to another, the caisson diameter is preferably approximately 15 to 20 feet and the caisson length is about 30 to about 65 feet. A plurality of pipe sections 7 are joined to the caisson 1 by suitable means such as flanged members 9. In a preferred embodiment, a cone shaped member 11 is utilized to connect the conductor pipe portions 7 with the caisson 1.

Once the conductor piping 7 has been connected to the caisson 1, the entire assembly may be lowered into the water until the lower portion 13 of the caisson rests on the sea floor. As is shown in FIG. 1B the caisson 1 may penetrate the depth of the sea floor slightly due to the weight of the caisson 1 and the attached conductor piping 7. The depth of this penetration will obviously vary depending upon the soil conditions at the sea floor.

Conductor piping sections 7 are extended above the water level 15 in order to insure a positive fluid head in the drilling operation which will be subsequently described in greater detail. A preferred height above the sea level in order to insure such a positive fluid head is at least 15 feet and preferably approximately 15 feet. A drill stem 17 may now be inserted within the conductor piping 7 and caisson 1. Attached to the drill stem 17 may be a drilling and reaming tool 19. The drill stem or string 17 and attached drilling and reaming tool 19 are lowered through the conductor piping 7 and caisson 1 until the drill stem 17 and drilling and reaming tool 19 rest on the sea floor inside the caisson 1. Drilling mud is now circulated within a closed system downward through the annular space 21 formed between the conductor piping 7 and the drill stem 17. This drilling mud is allowed to fill the interior volume of the caisson 1, cone member 11 and the annular space 21. During the drilling operation, the drilling mud and at least a portion of the cuttings produced during the drilling operation are moved upwardly through the drill stem 17, the drilling and reaming tool 19 being provided with a circulating element which permits the passage of drilling fluids through the drilling and reaming apparatus 19. The provision of such a closed system prevents any contamination of the surrounding environment by the drilling mud or cuttings.

The drilling and reaming tool 19 may be utilized to drill a hole to a predetermined depth. In a preferred embodiment, this depth is approximately 60 feet below the sea floor. At this point one or more reaming arms 23 may be gradually opened outward and rotated while the drilling and cutting tool 19 is pulled upwardly thereby "upreaming" and forming a cylinderical cavity within which the caisson 1 may be placed. Alternately this upreaming operating may be carried out without changing the depth of the tool 19 thereby excavating a bell shaped cut. Depending upon the depth at which the caisson is positioned beneath the sea floor, one or more of such bell cuts may be required. Should more than one be necessary, after the bell cut has been completed, the bell arms 23 are retracted inwardly and the cutting and reaming tool 19 is elevated and another bell cut is made. This process is repeated until the final bell cut is made adjacent the bottom of the caisson. It is to be noted that all of the cuttings produced during the drill and belling operation may not be removed with the circulated drilling mud, the portion of the cuttings remaining in suspension and assisting in the wall support while further cutting operations continue and while the caisson 1 is being lowered into its final position.

After the caisson cavity is made and the caisson 1 is lowered into the area cut by the drilling and reaming tool 19, the remaining cuttings may be reversed-circulated out of the volume of the caisson. The drill stem 17 and drilling and reaming tool 19 may now be removed from the caisson 1, cone element 11 and conductor pipe 7. At this time cement may be pumped to the base of the caisson in order to firmly anchor it into position. In a preferred embodiment a concrete base of approximately 5 feet in thickness is provided. Finally, the conductor piping 7 and cone element 11 may be removed from the caisson.

A barge generally referred to as 25 may be provided with a crane and boom assembly generally referred to as 27 in order to physically position the caisson 1 and conductor piping 7 on the sea floor. The reverse circulation may be assisted by means of air injected through a conductor member or hose 29. A recirculation tank 31 is shown having an inlet member or hose 33 outlet member or hose 35. A circulation pump 37 may be provided which pumps the recirculation mud 37 through an outlet member or hose 35 and into the annular space 21 between the conductor member 7 and the drill stem 17. A hydraulic power unit 39 may be provided having an inlet conductor member or hose 41 and an outlet conductor member or hose 43, the hydraulic power unit being utilized to provide for the hydraulic drive of a hydraulic drive table which is attached to drill stem 17.

Although preferred embodiments of the invention have been described, it will be readily apparent that alterations and modifications can be resorted to without parting from the scope of the invention, and such alterations and modifications are intended to be included within the scope of the appended claims.

What is claimed is:

1. A method for placing an offshore caisson comprising:

connecting at least one conductor section to said caisson, said conductor having a cross-sectional area less than the cross-sectional area of said caisson;

lowering said caisson and said conductor section to a predetermined position on the underwater floor;

positioning a drill stem having a combined drilling and reaming tool attached thereto within said conductor section and said caisson;

reverse-circulating a drilling mud through the annular space between said connected conductor section and caisson and said drill stem, said drilling mud returning through said drill stem;

drilling with said drilling and reaming tool to a predetermined depth;

opening and rotating at least one reaming arm of said drilling and reaming tool; and positioning said caisson within the area drilled and reamed by said drilling and reaming tool.

2. The method claimed in claim 1 wherein said method is further described as reaming in an upward direction.

3. The method claimed in claim 1 wherein said caisson is positioned such that said caisson is substantially beneath the underwater floor.

4. The method claimed in claim 1 wherein the cut produced by said reaming arm is approximately 1 foot larger in diameter than the caisson diameter.

5. The method claimed in claim 1 wherein said reverse circulating is carried out in a closed system.

6. A method for placing an offshore caisson comprising:

connecting at least one conductor section to said caisson, said conductor having a cross-sectional area less than the cross-sectional area of said caisson;

lowering said caisson and said conductor section to a predetermined position of the underwater floor;

positioning a drill stem having a combined drilling and upreaming tool attached thereto within said conductor section and said caisson;

reverse-circulating a drilling mud through the annular space between said joined conductor section and caisson and said drill stem, said drilling mud returning through said drilling and upreaming tool and said drill stem;

drilling with said drilling tool to a predetermined depth;

opening and rotating at least one reaming arm of said upreaming tool;

positioning said caisson within the area drilled and reamed by said drilling and belling tool;

removing said drill stem and drilling and upreaming tool from said caisson and disconnecting said conductor section from said caisson.

7. The method claimed in claim 6 wherein said method is further described as comprising cementing the lower portion of the caisson to the underwater floor.

8. The method claimed in claim 6 wherein said conductor section is extended above the water level.

9. The method claimed in claim 6 wherein said conductor section is extended at least 10 feet above the water level.

10. A caisson placing device comprising:

a caisson;

a drill stem having a combined drilling and reaming tool;

at least one conductor section connected to said caisson, said conductor section having a cross-sectional area which is substantially less than the cross-sectional area of the caisson, and being adapted to receive said drill stem having a combined drilling and reaming tool;

reverse-circulating drilling mud means for reverse circulating drilling mud through the annular space between said joined conductor section and said caisson and said drilling stem, said reverse-circulating drilling mud means being adapted to return said drilling mud through said drill stem.

11. The caisson placing device claimed in claim 10 wherein the caisson diameter is at least about 15 feet.

12. The caisson placing device claimed in claim 10 wherein said caisson is connected to said conductor section by means of a cone shaped member.

* * * * *